US005482176A

United States Patent [19]

Maietta et al.

[11] Patent Number: 5,482,176

[45] Date of Patent: Jan. 9, 1996

[54] MEMBRANE PIERCING CLOSURE AND SPOUT ASSEMBLY

[75] Inventors: Michael Maietta, Cogan Station; Thomas A. Frazier, Williamsport, both of Pa.

[73] Assignee: The West Company, Incorporated, Lionville, Pa.

[21] Appl. No.: 214,799

[22] Filed: Mar. 16, 1994

[51] Int. Cl.[6] ..... B65D 17/42

[52] U.S. Cl. ..... 220/277; 215/220; 222/80; 222/83; 229/125.15

[58] Field of Search ..... 215/252, 213, 215/220; 220/277, 256; 222/80, 83; 229/125.15

[56] References Cited

U.S. PATENT DOCUMENTS

| | | | |
|---|---|---|---|
| 3,156,369 | 11/1964 | Bowes et al. . | |
| 3,407,976 | 10/1968 | Homma . | |
| 3,756,444 | 9/1973 | McIntosh | 215/220 |
| 3,817,416 | 6/1974 | Costa | 215/213 |
| 3,841,513 | 10/1974 | O'Connor et al. . | |
| 3,843,006 | 10/1974 | Naito et al. | 215/220 |
| 4,483,464 | 11/1984 | Nomura | 222/83 |
| 4,723,689 | 2/1988 | Vallos et al. | 222/83 |
| 4,747,501 | 5/1991 | Greaves . | |
| 5,076,493 | 12/1991 | Anderson | 229/125.15 |
| 5,147,070 | 9/1992 | Iwamoto | 222/83 |

FOREIGN PATENT DOCUMENTS

| | | | |
|---|---|---|---|
| 1189439 | 4/1970 | United Kingdom | 222/83 |

*Primary Examiner*—Allan N. Shoap
*Assistant Examiner*—Robin A. Hylton
*Attorney, Agent, or Firm*—Eugene E. Renz, Jr.

[57] ABSTRACT

A closure assembly for piercing a diaphragm over a discharge opening in a container comprising a cap of cup-like form having internal thread means and a generally tubular spout member mounted on the container surrounding the diaphragm and a piercing fitment disposed interiorly of the spout member having a series of depending teeth arranged in a circular array and cooperating interengaging means between the spout member and piercing fitment and cap whereby rotational movement of the cap in one direction effects downward displacement of the piercing fitment to pierce the diaphragm.

8 Claims, 5 Drawing Sheets

MEMBRANE PIERCING CLOSURE AND SPOUT ASSEMBLY

FIELD OF THE INVENTION

The present invention relates to a container-closure assembly incorporating a pour spout and frangible closure seal.

BACKGROUND OF THE INVENTION

Container-closure assemblies of the generally type described above are not new per se.

Closures of this general type are shown in the patents listed below.

BOWES ET AL.
BICAMERAL CONTAINER
U.S. Pat. No. 3,156,369
Issued: Nov. 10, 1964
HOMMA
CONTAINER WITH PLURAL POUR SPOUTS AND FRANGIBLE CLOSURE
U.S. Pat. No. 3,407,976
Issued: Oct. 20, 1968
O'CONNOR ET AL.
CONTAINER HAVING SAFETY CLOSURE
U.S. Pat. No. 3,841,513
Issued: Oct. 15, 1974
GEAVES
CONTAINER CLOSURE METHOD
U.S. Pat. No. 4,747,501
Issued: May 31, 1988

SUMMARY OF THE INVENTION

The present invention provides a novel fitment enclosed within a spout which may be actuated to provide a discharge opening in a membrane seal on an aseptic package. More specifically, the assembly comprises a closure cap having spiral threads which mate with the external spiral threads on a spout member mounts over a membrane type seal in the discharge end of the package. A piercing fitment having a plurality of piercing teeth at its internal terminal end threadedly engages interiorly of the spout member and to be selectively actuatable to pierce the membrane upon operation of the closure cap in a direction to remove it from the container. To this end, the cap includes a series of driving posts which depend from the interior of the top of the cap and engage circumferentially spaced axially extending grooves in the piercing fitment. The piercing fitment is normally disposed within the spout member so that the teeth extending from inner end thereof are spaced above the membrane in the container. Accordingly, when the closure cap is rotated in the direction to remove it from the pouring spout, the posts engage in the splines of the piercing fitment thereby to rotate the piercing fitment in an opposite direction so that it is actuated downwardly against the membrane. It has been found, in a cycle of operation, the membrane is severed save for a connecting hinge in the manner shown in FIG. 13.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
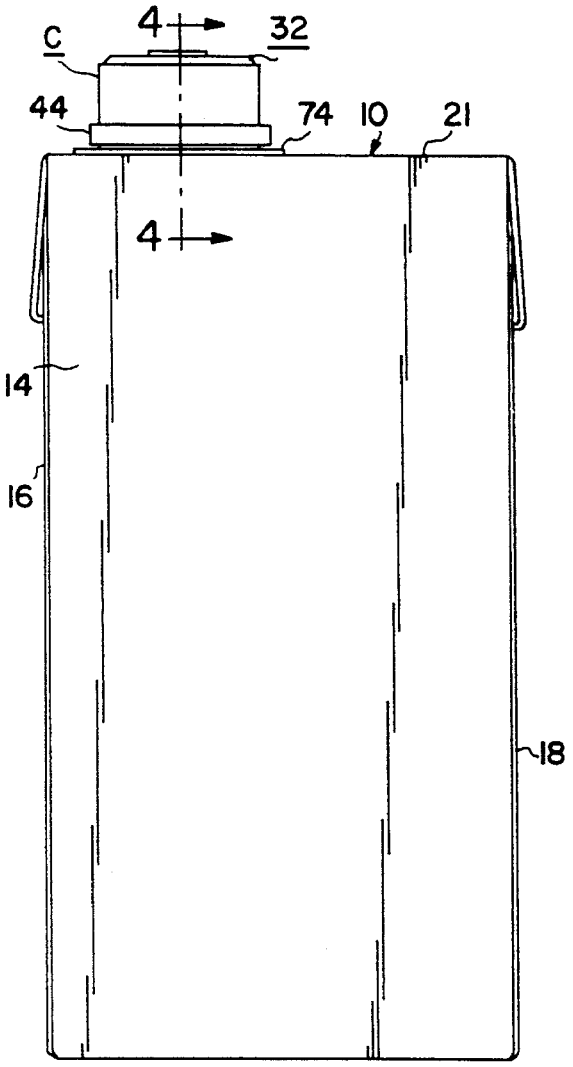
FIG. 1 is a front elevational view of a typical aseptic paper package for containing liquid products such as milk and a novel membrane piercing closure and spout assembly in accordance with the present invention.
Figure 3:
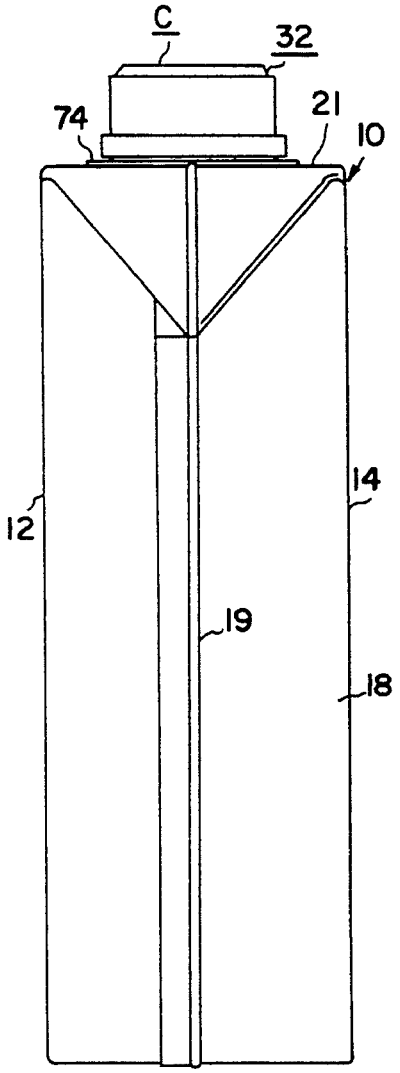
FIG. 3 is a right hand side elevational view of the aseptic paper package and closure assembly shown in FIG. 1.
Figure 2:
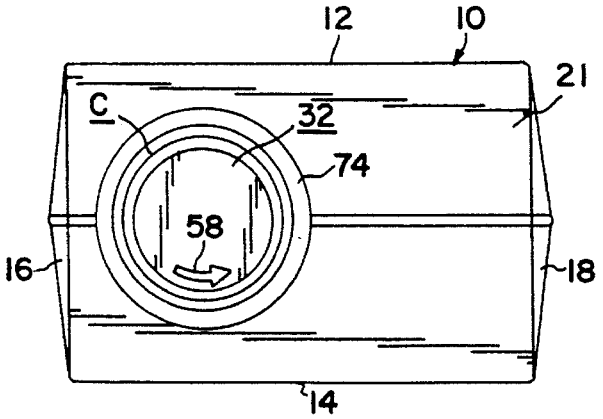
FIG. 2 is a plan view of the aseptic paper package and closure assembly shown in FIG. 1.

Referring now to the drawings and particularly to FIGS. 1–3 there is illustrated a typical package of the type to which the piercing closure and spout assembly of the present invention has particular application. The container is broadly designated by the numeral 10 and is of generally box-like shape having rectangular front and rear panels 12 and 14 respectively and side panels 16 and 18 spanning the front and rear panels connected thereto along vertical bend line 19. The sides and bottom have overlapping sealed seams so that the package illustrated is of generally box-like form and is constructed in a manner to provide an aseptic container for liquid products such as milk where the shelf life can be increased considerably since they do not require refrigeration. The package is of a well known construction and is made primarily of cardboard having a foil inner liner and an outer coating which makes the cardboard impervious to moisture.

Figure 4:
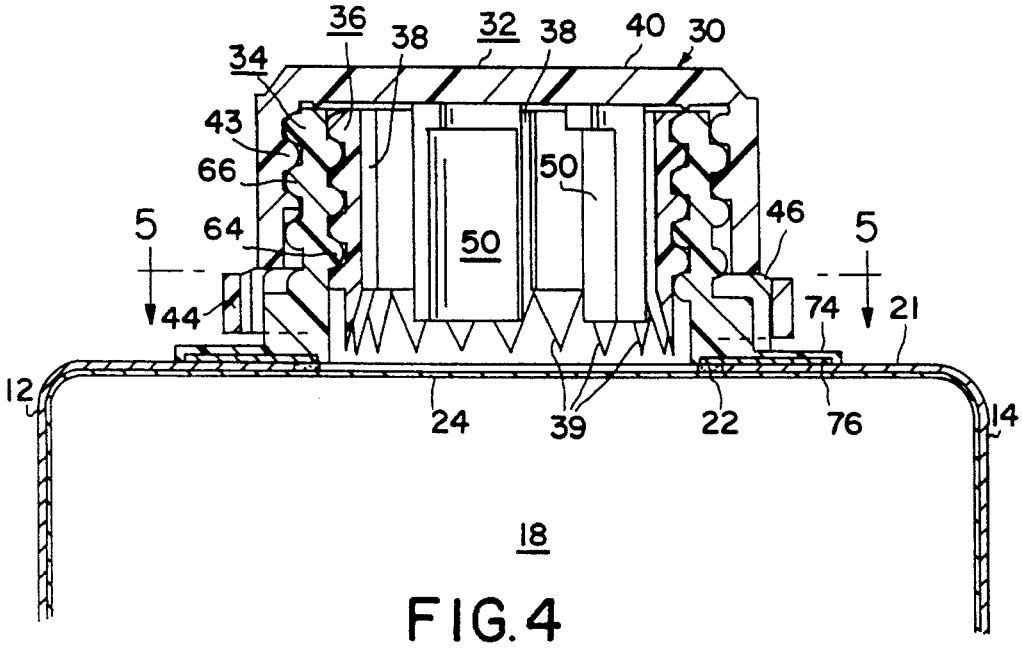
FIG. 4 is an enlarged sectional view taken on the lines 4—4 of FIG. 1 showing the membrane piercing closure and spout assembly fixedly attached to the top of the aseptic package and overlying the membrane sealed port of the package.
Figure 5:
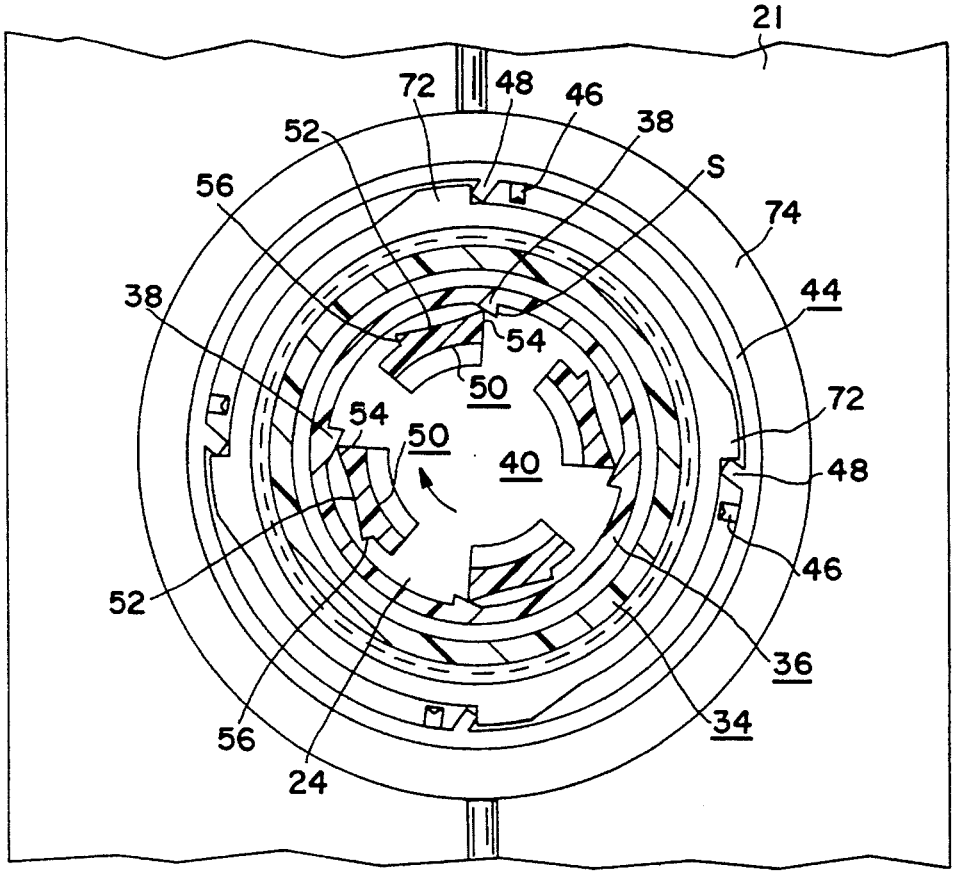
FIG. 5 is a sectional plan view taken on the lines 5—5 of FIG. 4 showing additional details of the closure assembly.
Figure 6:
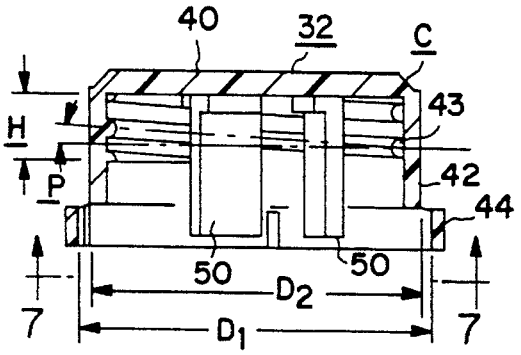
FIG. 6 is a sectional elevational view at a slightly reduced scale than FIGS. 4 and 5 of the closure member of the assembly.
Figure 7:
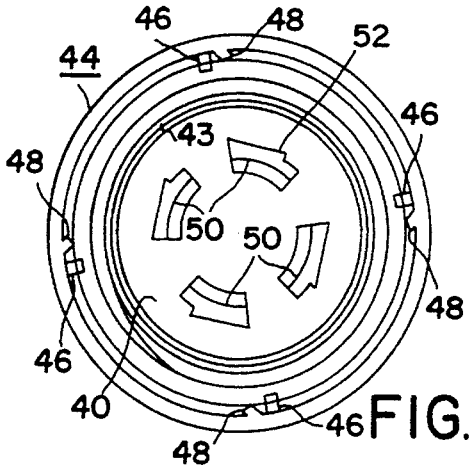
FIG. 7 is a bottom plan view of the closure member as viewed along the lines 7—7 of FIG. 6.
Figure 8:
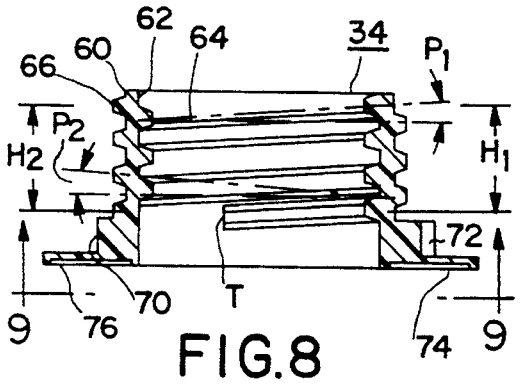
FIG. 8 is a sectional elevational view at the same scale as FIG. 6 of the spout member of the assembly.
Figure 9:
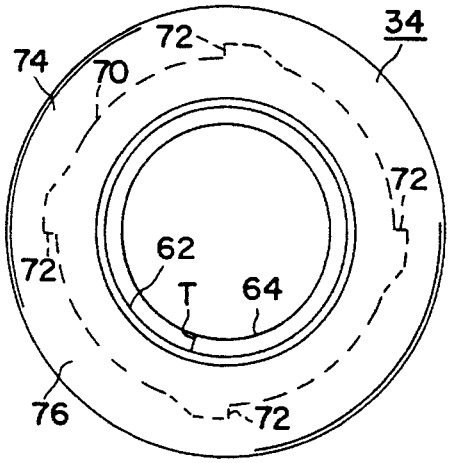
FIG. 9 is a bottom plan view of the spout member is viewed along the lines 9—9 of FIG. 8.
Figure 10:
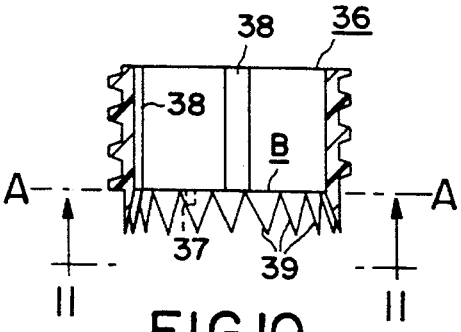
FIG. 10 is a sectional elevation view of the piercing fitment member at the same scale as in FIGS. 6–9.
Figure 11:
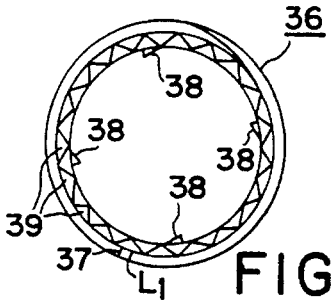
FIG. 11 is a bottom plan view of the piercing fitment member as viewed along the lines 11—11 of FIG. 10.

The top panel 21 has a cutout 22 exposing the foil which functions as a diaphragm 24 in a manner to be described hereafter. As best illustrated in FIGS. 4 and 5 the piercing closure and spout assembly of the present invention is mounted over the diaphragm 24 in the manner illustrated and may be attached thereto by an adhesive such as glue.

Referring now to the drawings, and particularly, to FIGS. 6–12 inclusive the piercing closure and spout assembly in accordance with the present invention is generally designated by the numeral 30. The basic components of the assembly comprise a closure cap 32, a spout member 34 and a piercing fitment 36 which interengage and nest in the manner shown in FIG. 4 and are actuatable relative to one another between the nested position (FIG. 4) and an actuated position as shown in FIG. 13 to produce a discharge opening O in the diaphragm 24 when desired to discharge contents of the container.

The closure cap 32, as illustrated, includes a disc like top 40, a depending side wall or skirt 42 having an internal spiral thread configuration 43 of predetermined pitch P and predetermined height H. In the present instance, the threads 43 extend only to a predetermined depth H so that the closure cap can be fully removed in about one and a quarter turns of the cap relative to the spout member 34. The closure cap 32 includes a tamper evident band or ring 44 connected to the lower terminal edge of the side wall 42 by plurality of circumferentially spaced, fracturable bridges 46. The tamper evident band 44 has a series of circumferentially spaced radially inwardly projecting anti-rotation lugs 48 preventing rotation of the closure cap 32 in a direction to remove it when the assembly is in the nested position shown in FIG. 4. Thus, attempts to remove the closure cap 32 produce breaking of the bridges 46 and visual indica that the cap has been once removed. More specifically, the tamper band 44 is of a larger diameter $D_1$ than the diameter $D_2$ of side wall 42 and when the bridges are fractured is displaced axially away from the wall skirt 42 to show the fractured bridges 46 and produce a gap which are indicia to the user that the closure cap has once been opened. This may be important for certain types of products which either have a limited shelf life or will contaminate when exposed to the ambient environment, such as milk.

Figure 13:
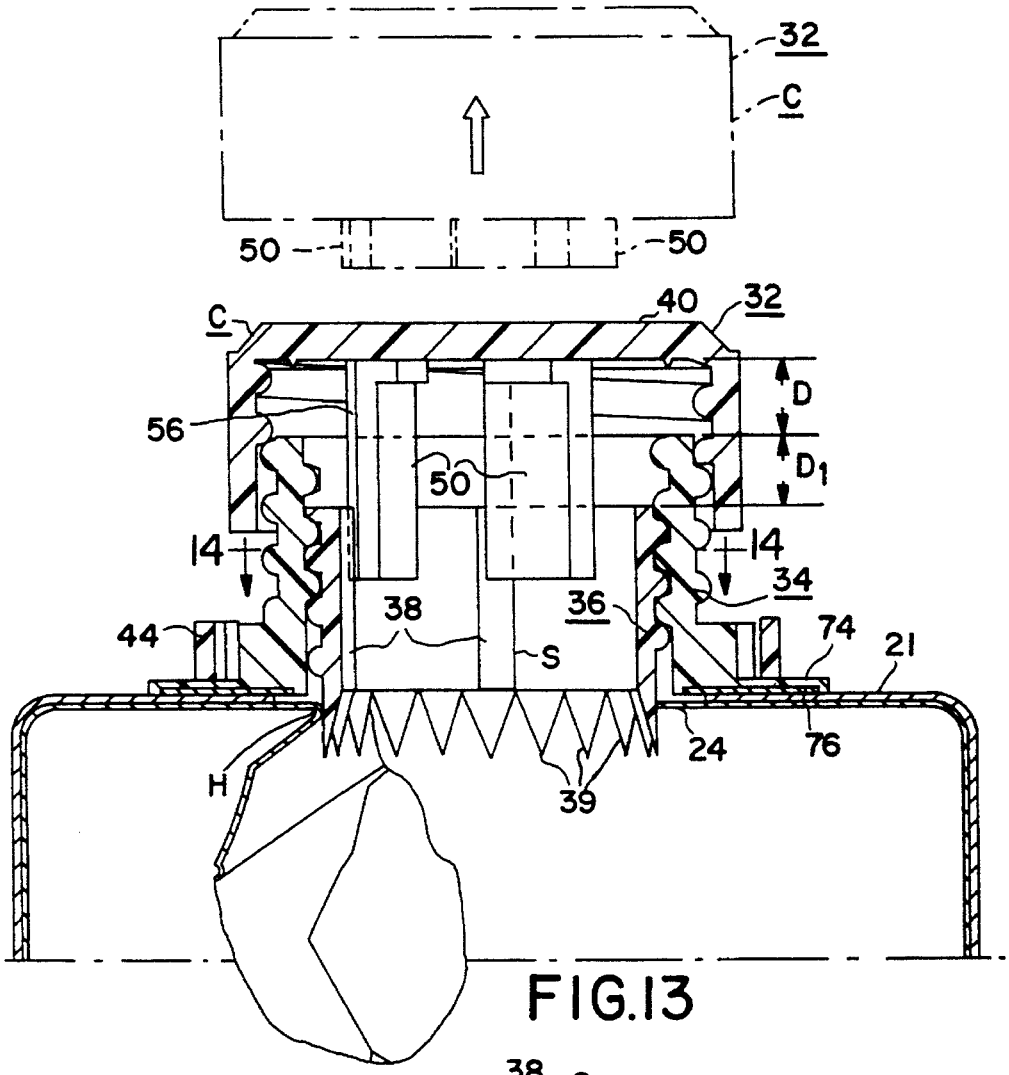
FIG. 13 is an enlarged sectional elevational view similar to FIG. 4 but showing the closure member having been rotated in a counterclockwise direction through approximate 450° for the closure moving upward and away from the spout flange.
Figure 14:
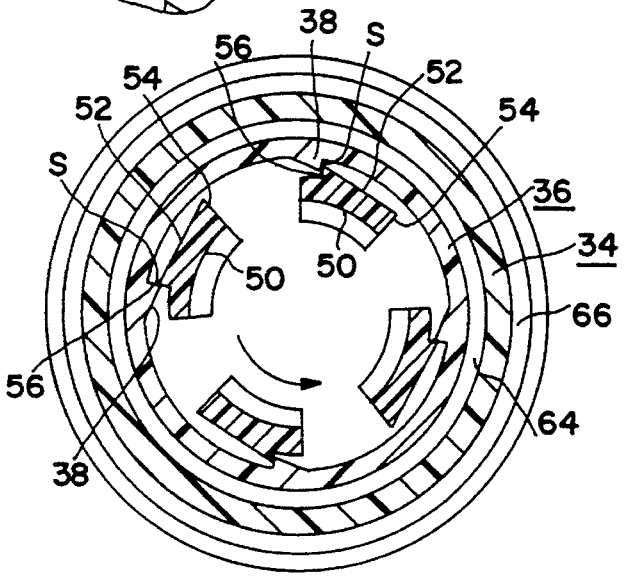
FIG. 14 is a fragmentary sectional plan view taken on the lines 14—14 of FIG. 13 showing the four (4) actuating posts integrally attached to the closure member in driving contact with the splined ratchets on the inside circumference of the piercing fitment.
Figure 15:
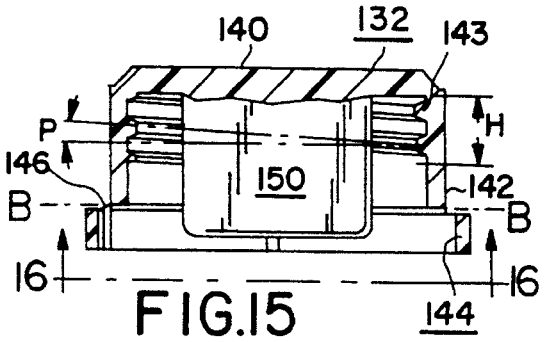
FIGS. 15–18 inclusive are views showing a modified embodiment of the present invention.
Figure 19:
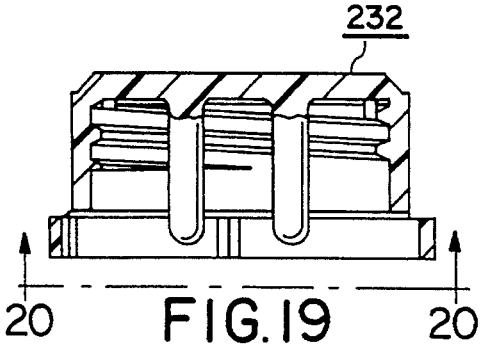
FIGS. 19–22 inclusive show still another modified embodiment of the present invention.
Figure 16:
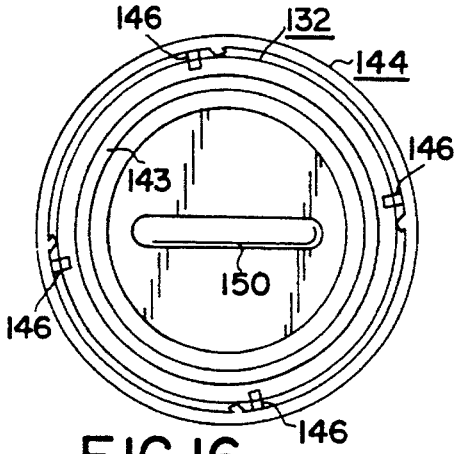
Figure 20:
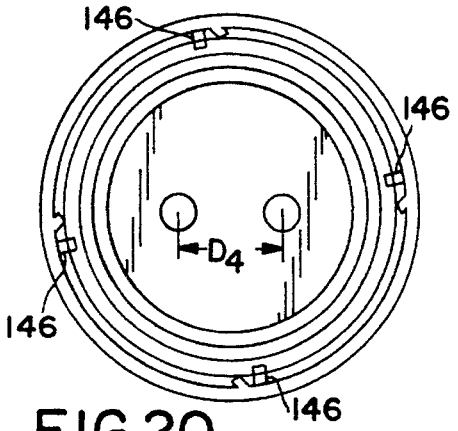
Figure 17:
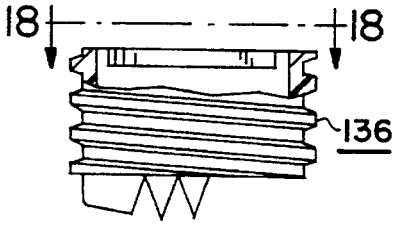
Figure 21:
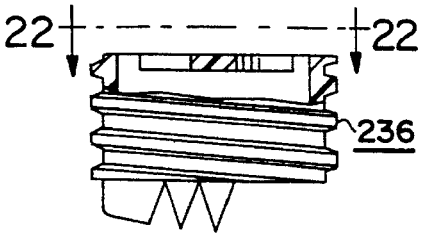
Figure 18:
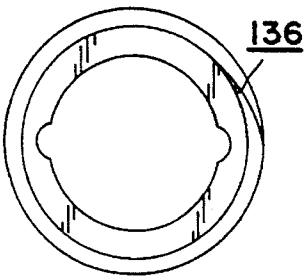
Figure 22:
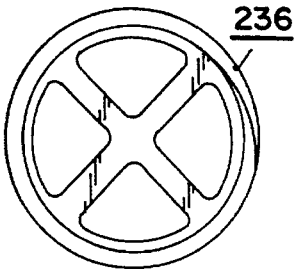

The closure cap 32 also includes an array of circumferentially spaced driving posts 50 depending from the top 40. See FIGS. 7 and 14. Each driving post 50 has an exterior face 52 having lead and trailing shoulders 54 and 56. The leading and trailing edges 54, 56 of the driving post 50 effect displacement of the piercing fitment 36 to penetrate the diaphragm 24 and form the discharge opening during activation of the piercing fitment 36 from the nested position shown in FIG. 4 to the extended and fully actuated position shown in FIG. 13. The driving posts 50 also cooperate with piercing fitment 36 to retract it into the spout member 34 when reapplying the closure cap 32 to the spout member 34. Indica in the form of an arrow 58 is formed on the top face of the closure cap 32 to indicate direction of rotation of the cap to remove it.

The spout member 34 comprises an elongated tubular or cylindrical body 60 having an internal bore 62 with internal spiral threads 64 of a predetermined pitch $P_1$ and predetermined height $H_1$. The spout member also has a spiral thread 66 formed on the outer peripheral surface of the body portion 60 of a predetermined pitch $P_2$ and predetermined height $H_2$. The body portion of the spout member terminates in an enlarged shoulder section 70 at its inner terminal end which has a series of circumferentially spaced radially outwardly directed lugs 72. The lugs 72 cooperate with the anti-rotation lugs 48 of the tamper evident band. The lugs 72 are angled to permit the lugs of the tamper evident ring to ratchet over the lugs on the spout member shoulder during application of the closure cap and resist rotation in the opposite direction to effect fracture of the bridges in the manner described in more detail below. The spout member has a circumferentially extending flange 74 at its lower end having a recessed lower face or cavity 76 for retaining adhesive for applying the spout member to the container in a manner described more specifically hereafter.

The piercing fitment 36 has a tab or lug 37 defining a limit stop $L_1$ which projects radially outwardly at the lower edge of the piercing fitment 36 in a plane A—A through the base B of the teeth 39. The limit stop $L_1$ is positioned to engage the bottom of the internal spiral thread 64 on the spout member 34. The limit stop $L_1$ and shoulder T of the spiral threads work together in the following manner. The pans comprising the cap spout member 34 and piercing fitment 36 are preassembled before being applied to the membrane or container walls surrounding the membrane by first threading the piercing fitment 36 into the bottom end of the spout member 34 in a clockwise direction until the limit stop $L_1$ abuts the shoulder T of the spiral thread 64. The piercing fitment 36 and spout member 34 are then in the relative position shown in FIG. 4. The closure cap 32 is then positioned over the open end so that the spaces between the posts 50 are generally aligned with the ramp faced splines 38 of the piercing fitment 36. In this position, the closure cap 32 is rotated in a clockwise direction as shown in FIG. 5 so that it is fully assembled to the spout member 34 as shown in FIG. 4. It is noted that during rotation of the cap 32 in this manner, the edge 54 of the post 50 engage the ramp R faced splines 38 on the piercing fitment and the piercing fitment is restrained from rotation by engagement of the limit stop L against the shoulder T and that the post 50 flex inwardly as they pass over the ramp faced splines 38 of the piercing fitment allowing the closure cap 32 to be fully seated on the spout member 34. The closure cap 32 is then threaded to its fully seated position shown in FIG. 4. The assembly is now ready to apply to the top of the container so that the parts are in the position shown in FIG. 4. In the present instance, the extended flange at the lower end of the spout member is glued to the top of the container surrounding the diaphragm. Now when the closure cap is rotated in a counterclockwise direction to remove it, the opposing shoulder 54 of each of the posts 50 rotates to a position where they engage the shoulder S of the ramp R whereby upon continued rotation of cap in this direction, the cap is actuated axially upwardly and the piercing fitment 36 is driven axially downwardly and during this activation, the diaphragm is severed in the manner shown in FIG. 13 producing a hinge H by reason of the bunching of the material at the hinge.

Consider now the operation of the closure and fitment of the present invention. The parts are initially in the relative positions shown in FIG. 4, wherein the piercing element 36 nested within the pouring spout 34 and the piercing teeth 39 are spaced above the diaphragm 24 over the discharge opening 22 in the package 10. The bridges 46 connecting the cap portion of the closure 52 to the tamper evident ring 44 are intact and provide visual indica that the diaphragm seal has not been tampered with. Now when it is desired to activate the system, the cap 32 is rotated in a counterclockwise direction. During initial rotation of the cap in a counterclockwise direction, the anti-rotation lugs 48 engage the radial shoulder 72 of the base of the pouring spout 34 whereby continued rotation of the cap fractures the bridges 46 and permits removal of the cap. As the cap or closure 32 rotates counterclockwise and is displaced upwardly from the spout flange 74 in the manner shown in FIG. 13, the piercing fitment 36 also rotates in a counterclockwise direction and by reason of the post 50 interengaging with the shoulder of the ramp faced spline 38 the piercing fitment 36 is actuated axially downwardly in the opposite direction of the cap 32. In the present instance since the pitch of the cap threads 43 and the piercing fitment threads are the same, the vertical displacement distance D traveled by the cap upwardly is equal to the vertical displacement $D_1$ of the piercing element in the opposite direction. As the piercing fitment rotates and moves axially downwardly, the sharp edges of the piercing teeth penetrate the membrane and cut the membrane in a circular path. It is noted, that the membrane material tends to bunch at a flap location F and this provides a hinge holding the membrane attached to the container at the hinged location. The cap can be completely removed and at the contents of the package discharge through the discharge opening. It is noted that after use, the cap can be reapplied to the package spout and rotated clockwise through approximately 450° to reposition the closure and the piercing fitment the closed position in FIG. 4. It is noted that assembly of the cap 32 during clockwise rotation thereof, posts 50 flexed inwardly past ramp faced splines 38 and when the cap 32 is rotated in a counterclockwise direction to remove it, the shoulder 56 of post 50 engages shoulder S of ramp faced spline 38.

Figure 12:
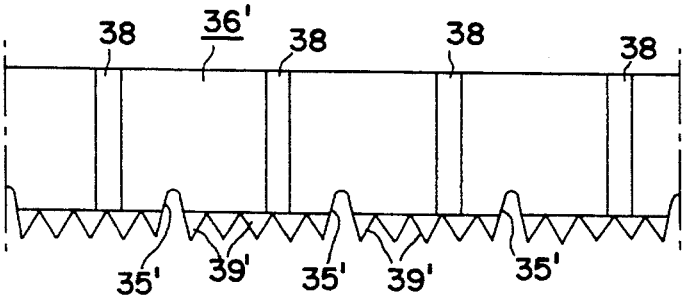
FIG. 12 is a 360° development of a modified piercing fitment having piercing and cutting teeth of less length and four (4) equally spaced gaps in the tooth array.

There shown in FIG. 12 a modified tooth array in accordance with the present invention. In this instance, the tooth array includes a plurality teeth 39' and circumferentially spaced gaps 35 separating the teeth array into groups.

There is illustrated in FIG. 15–18 a modified version of a cap and piercing fitment in accordance with the present invention. The closure cap 132 is of generally cup like form having a disc like top 140, a depending peripherally circumferentially extending sidewall 142 having an internal spiral thread configuration 143 of a predetermined pitch P and a predetermined height H. Similar to the previous described embodiments, the threads 143 extend only to a predetermined depth H so that the closure cap can be fully removed in about one and a quarter (1¼) turns of the cap relative to the spout member 34. The closure cap also includes a tamper evident band or ring 144 connected by a series of fracturable bridges 146. In the present instance the cap includes a generally rectangular post 150 depending from the inside of the interface of the top wall which is illustrated extends slightly below the lower terminal edge of a plane B—B through the juncture of the cap and fracturable bridge. The piercing fitment is of a similar configuration of that described in connection with the preferred embodiment. Thus, the fitment includes a piercing fitment 136 which is generally similar to the previously described embodiment and has external screw threads on the outer periphery of the side wall which mesh with the internal threads of the spout member in much the same manner as described above. A series of circumferentially extending teeth depend from the lower terminal edge of the side wall. In the present instance the upper end of the piercing fitment has a radially inwardly directed flange with two diametrically opposed notches and cut outs adapted to receive the projection 150 which depends from the inner face of the top 140 to activate the system in much the same manner as described above.

The embodiment shown in FIGS. 19–22 inclusive is generally similar to that shown in FIG. 15–18 and accordingly, elements similar to those of the principal embodiment have been assigned the same numbers in the 200 series. Thus, the cap 232, spout member 234 and piercing fitment 236 interengage and function in the same manner as described previously. However, in the present instance instead of a rectangular 150 projection from the inner face of the top 140, there are two pin like projections which depend from the top which are spaced apart a predetermined distance $D_4$. These pins engage with portions of the piercing fitment to produce the opening and closing action described above. Thus, piercing fitment has an X-shaped top defining four (4) open quadrants. The pins on the cap are designed to engage in diametrically opposed quadrant openings in the top of the piercing fitment.

Even though particular embodiments of the present invention have been illustrated and described herein, it is not intended to limit the invention and changes and modifications may be made therein within the scope of the following claims.

What is claimed is:

1. A closure assembly for piercing a diaphragm sealingly engaged over a discharge opening in a container comprising:

a cap of cup-like form;

a generally tubular spout member mounted on the container over said discharge opening and a piercing fitment disposed interiorly of said spout member, said piercing fitment having a series of depending teeth arranged in a circular array;

a first interengaging means for allowing an interlocking fit between the spout member and said piercing fitment; and a second interengaging means for allowing an interlocking fit between said spout member and said cap whereby operation of said second interengaging means enables movement of the cap in a first direction for removing said cap from said spout member and simultaneously operates said first interengaging means and thereby effects displacement of said piercing fitment in a direction substantially opposite said first direction to pierce said diaphragm.

2. A closure assembly as claimed in claim 1, wherein:

said first interengaging means are cooperating spiral threads between said spout member and said piercing fitment and said second interengaging means are cooperating spiral threads between said cap and said spout member.

3. A closure assembly as claimed in claim 1, including a series of circumferentially spaced posts depending from the top of the cap having a first shoulder cooperatively associated with a plurality of splines on the interior wall of the piercing fitment, each of said plurality of splines having a ramp surface and a second shoulder, whereby during rotation of the cap in an opening direction the first shoulder engages the second shoulder to rotate the piercing fitment and displace said piercing fitment axially into the container and whereby rotation in a closing direction effects ratcheting of the first shoulder over the ramp surfaces of the splines.

4. A closure assembly as claimed in claim 1 further comprising:

a series of posts depending from the cap into said spout member; and notch means in said piercing fitment for providing residence for said posts.

5. A closure assembly for piercing a diaphragm sealingly engaged over a discharge opening in a container comprising:

a cap of cup-like form;

a generally tubular spout member mounted on the container over said discharge opening and a piercing fitment disposed interiorly of said spout member, said piercing fitment having a series of depending teeth arranged in a circular array;

a first interengaging means for allowing an interlocking fit between the spout member and said piercing fitment; and a second interengaging means for allowing an interlocking fit between said spout member and said cap whereby operation of said second interengaging means enables movement of the cap in a first direction for removing said cap from said spout member and simultaneously operates said first interengaging means and thereby effects displacement of said piercing fitment in a direction substantially opposite said first direction to pierce said diaphragm;

a series of posts depending from the top of the cap having a first shoulder cooperatively associated with a plurality of splines on an interior wall of the piercing fitment, each of said plurality of splines having a ramp surface and a second shoulder, whereby during rotation of the cap in an opening direction the first shoulder engages the second shoulder to rotate the piercing fitment and displace said piercing fitment axially into the container and whereby rotation in a closing direction effects ratcheting of the first shoulder over the ramp surfaces of the splines.

6. A closure assembly as claimed in claim 5, wherein:

said first interengaging means are cooperating spiral threads between said spout member and said piercing fitment and said second interengaging means are cooperating spiral threads between said cap and said spout member.

7. A closure assembly for piercing a diaphragm sealingly engaged over a discharge opening in a container comprising:

a cap of cup-like form;

a generally tubular spout member mounted on the container over said discharge opening and a piercing fitment disposed interiorly of said spout member, said piercing fitment having a series of depending teeth arranged in a circular array;

cooperating interengaging means between the cap, the spout member and said piercing fitment for enabling relative movement of said cap, said spout member and said piercing fitment; and a series of posts depending from the top of the cap having a first shoulder cooperatively associated with a plurality of splines on the interior wall of the piercing fitment, each of said plurality of splines having a ramp surface and a second shoulder, whereby during rotation of the cap in an opening direction, said cooperating interengaging means enables the first shoulder to engage the second shoulder means to to cause displacement of said piercing fitment axially into the container to pierce said diaphragm, and whereby rotation of the cap in a closing direction effects ratcheting of the first shoulder over the ramp surfaces of the splines.

8. A closure assembly as claimed in claim 7, wherein:

said cooperating interengaging means are cooperating spiral threads between said spout member and said piercing fitment and between said cap and said spout member.

* * * * *

UNITED STATES PATENT AND TRADEMARK OFFICE

CERTIFICATE OF CORRECTION

PATENT NO. : 5,482,176

DATED : Jan. 9, 1996

INVENTOR(S) : Michael Maietta, et al

It is certified that error appears in the above-indentified patent and that said Letters Patent is hereby corrected as shown below:

In column 4, line 20, "pans" should read --parts--.

Signed and Sealed this

Twenty-sixth Day of March, 1996

Bruce Lehman

*Attest:*

BRUCE LEHMAN

*Attesting Officer*

*Commissioner of Patents and Trademarks*